US006978887B1

(12) United States Patent
Bingham

(10) Patent No.: US 6,978,887 B1
(45) Date of Patent: Dec. 27, 2005

(54) COMBINED BIRTHDAY CANDLE AND MATCH PACKAGE

(76) Inventor: Victoria J. Bingham, 6442 Overbrook Dr., Alexandria, VA (US) 22312

( * ) Notice: Subject to any disclaimer, the term of this patent is extended or adjusted under 35 U.S.C. 154(b) by 0 days.

(21) Appl. No.: 10/940,381

(22) Filed: Sep. 14, 2004

(51) Int. Cl.[7] ..... A24F 15/00
(52) U.S. Cl. ..... 206/86; 206/38; 206/94; 206/778; 362/162
(58) Field of Search ..... 206/38, 86, 90–94, 206/96, 99, 104, 116, 119, 216, 223, 461, 206/775–778, 806; 362/161, 162; 431/291

(56) References Cited

U.S. PATENT DOCUMENTS

| | | | | |
|---|---|---|---|---|
| 164,620 | A | 6/1875 | Watson | |
| 450,949 | A | 4/1891 | Coste | |
| 494,249 | A | 3/1893 | Covington | |
| 798,627 | A | 9/1905 | Richardson | |
| 1,788,177 | A | 1/1931 | Traute | |
| 1,943,052 | A * | 1/1934 | Berry, Jr. | 206/94 |
| 1,948,418 | A | 2/1934 | Fung | |
| 2,098,096 | A | 11/1937 | Hollis | |
| 2,273,611 | A * | 2/1942 | Anderson et al. | 206/94 |
| 2,349,217 | A * | 5/1944 | Warp | 206/94 |
| 2,349,488 | A | 5/1944 | Dement | |
| 3,065,849 | A * | 11/1962 | Rice et al. | 206/92 |
| 5,096,057 | A * | 3/1992 | Yoo | 206/90 |
| 5,121,835 | A * | 6/1992 | Grupe | 206/806 |
| 6,644,470 | B1 * | 11/2003 | Grayson | 206/90 |

* cited by examiner

*Primary Examiner*—Luan K. Bui
(74) *Attorney, Agent, or Firm*—Beady, O'Boyle & Gates

(57) ABSTRACT

A combined birthday candle and match package wherein a box having front, back, end and side walls is provided with a plurality of matches integral and co-planar with the back wall. Perforations are provided between the matches and the back wall so that the matches can be individually torn from the back wall. A match striking surface is provided on an end wall. The front wall may include a window portion, and the back wall may include a foldable panel for covering the matches.

8 Claims, 6 Drawing Sheets

COMBINED BIRTHDAY CANDLE AND MATCH PACKAGE

BACKGROUND OF THE INVENTION

The continuing decrease of people smoking today at home and away results in fewer people carrying matches or a lighter or even having them in the home. Thus it can be disconcerting at a child's birthday party when it is time to light the birthday candles but no one has a light to ignite the candles.

While it is known to provide a box of candles with matches, it has been found that these boxes are complicated in construction and are designed specifically for containing candles in separate compartments within the boxes.

After considerable research and experimentation, the combined birthday candle are match package of the present invention has been devised which is constructed and arranged to provide a birthday candle container wherein a plurality of matches are integral with and form a wall of the container and and detachably connected therefrom.

SUMMARY OF THE INVENTION

The combined birthday candle and match package of the present invention comprises, essentially, a blank made of cardboard, or other suitable material, which, when cut and scored, is folded and adhesively secured to form a box having front and back walls, end and side walls. The portion of the blank providing the back wall of the container is formed by a plurality of planar matches detachably connected from each other and the remainder of the blank providing the back wall of the container. The end wall of the container is provided with a striking surface for the matches. The back wall of the container is also provided with an apertured tab so that the package can be hung from a display rack.

In one embodiment, the front wall of the container is provided with a window for displaying the candles in the package.

In another embodiment, the portion of the blank forming the back wall of the container is provided with an extended flap or panel which is adapted to be folded over the matches when the container is constructed to thereby provide a cover for the matches.

In yet another embodiment, the front wall of the package has no window.

DESCRIPTION OF THE PREFERRED EMBODIMENTS

Figure 1:
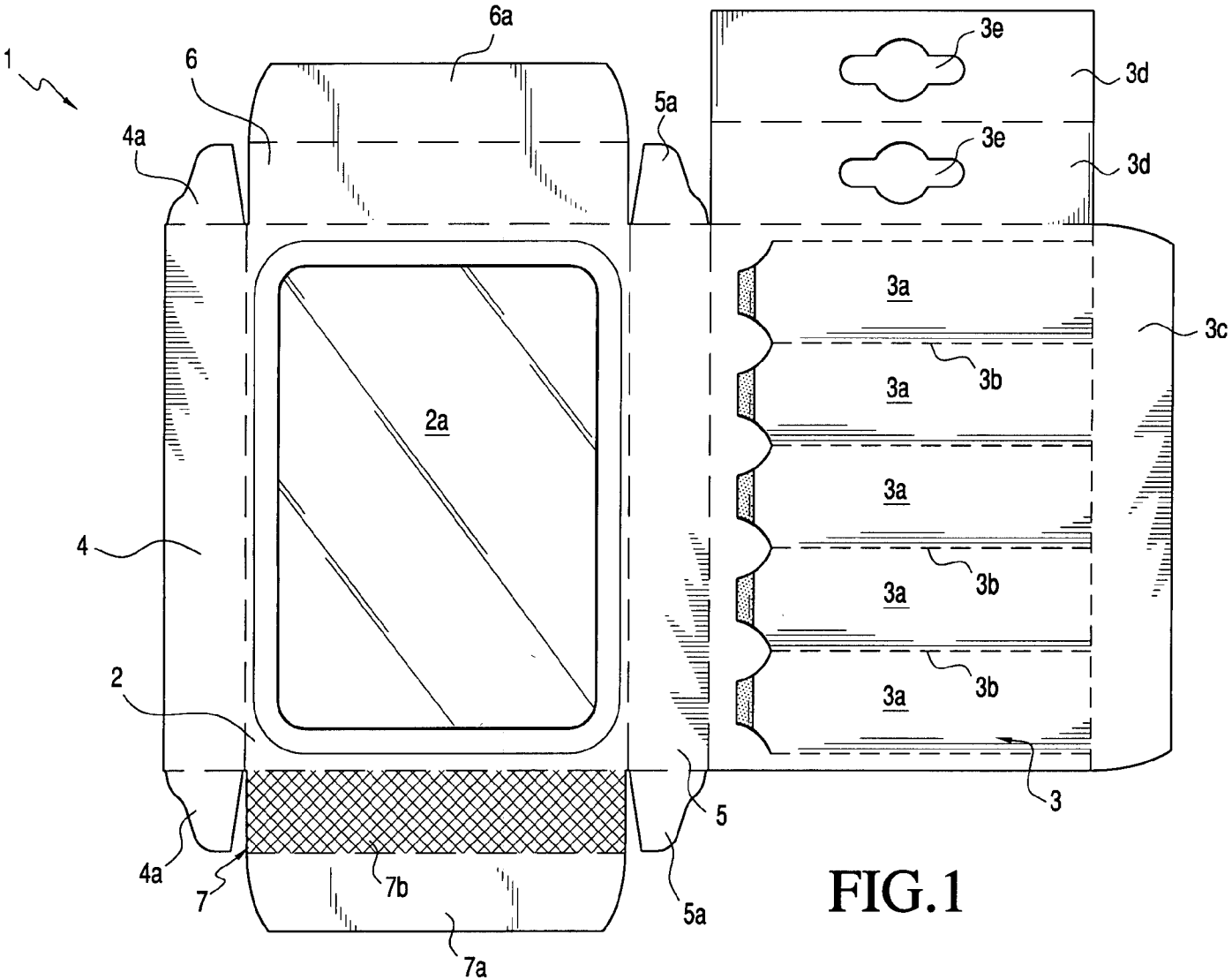
FIG. 1 is a top plan view of a blank, cut and scored before being folded into a container.

Referring to the drawings and more particularly to FIG. 1, the combined birthday candle and match package of the present invention comprises a blank 1 of cardboard, plastic or other suitable material which is cut and scored to form a front panel 2 having a window portion 2*a*, a back panel 3, side panels 4 and 5 and end panels 6 and 7. Each of the side panels 4 and 5 have flap portions 4*a*, 5*a* and the end panels 6 and 7 have flap portions 6*a*, 7*a* which, when folded inwardly and adhesively secured to each other, form the front wall 2, side walls 4 and 5, and end walls 6 and 7 of the container shown in FIGS. 2 and 3. The end wall 7 has a striking surface 7*b*.

The back panel 3 includes a plurality of co-planar matches 3*a* detachably connected from each other and the remainder of the panel by perforations 3*b*. The back panel 3 also includes a flap portion 3*c* which, when folded inwardly, cooperates with panel 4 to form the side wall 4 of the container. The back panel 3 also includes tab portions 3*d*, having apertures 3*e* to be folded upon themselves, as shown in FIGS. 2 and 3, to provide a hanger for detachably suspending the container from a display rack (now shown).

Figure 2:
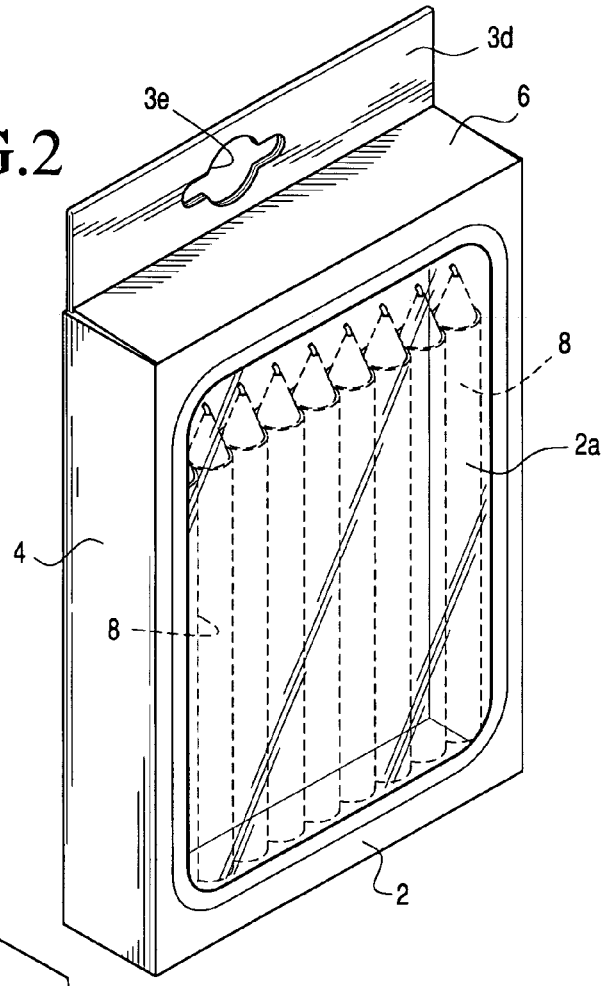
FIG. 2 is a front perspective view of one embodiment of the invention wherein the blank of FIG. 1 has been folded to form a package containing candles and having a window in the front face of the package.
Figure 3:
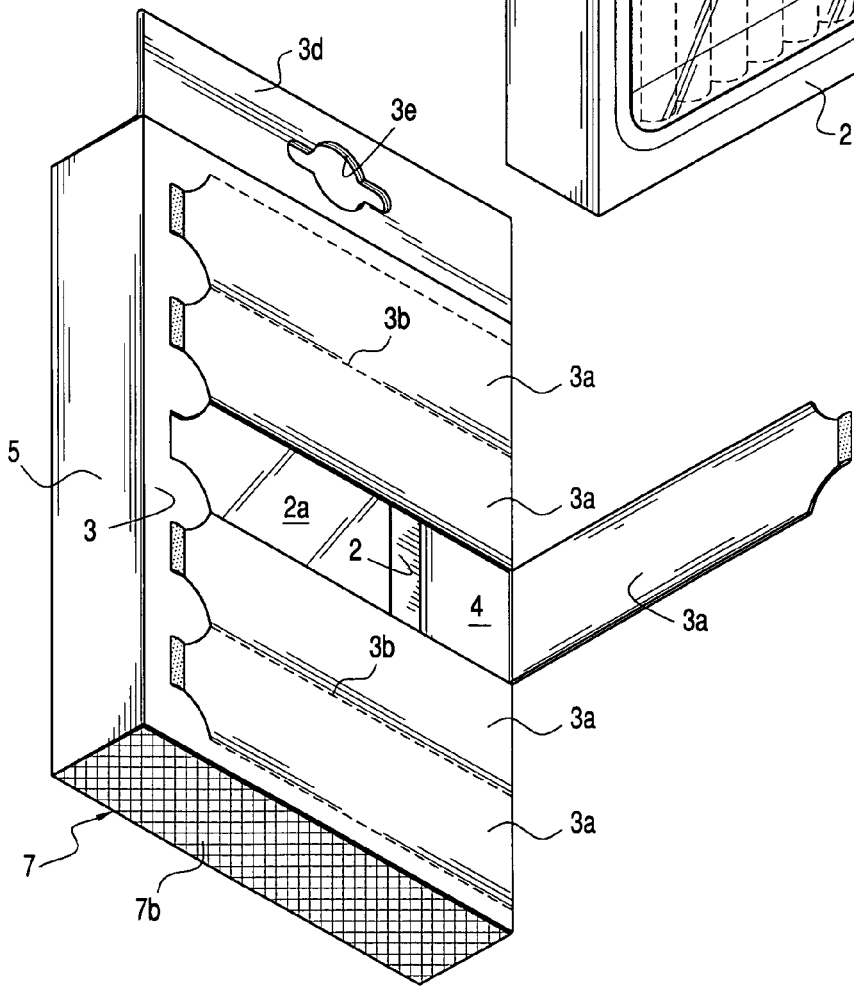
FIG. 3 is a rear perspective view of the package shown in FIG. 2, illustrating a match being pulled from the back wall of the package and a striking surface on an end of the package.

As will be seen in FIGS. 2 and 3, the container is filled with birthday candles 8, and the matches 3*a* are tearable away from the back panel 3, as shown in FIG. 3, and are adapted to be struck on the surface 7 whereby the match 3*a* is ignited.

Figure 4:
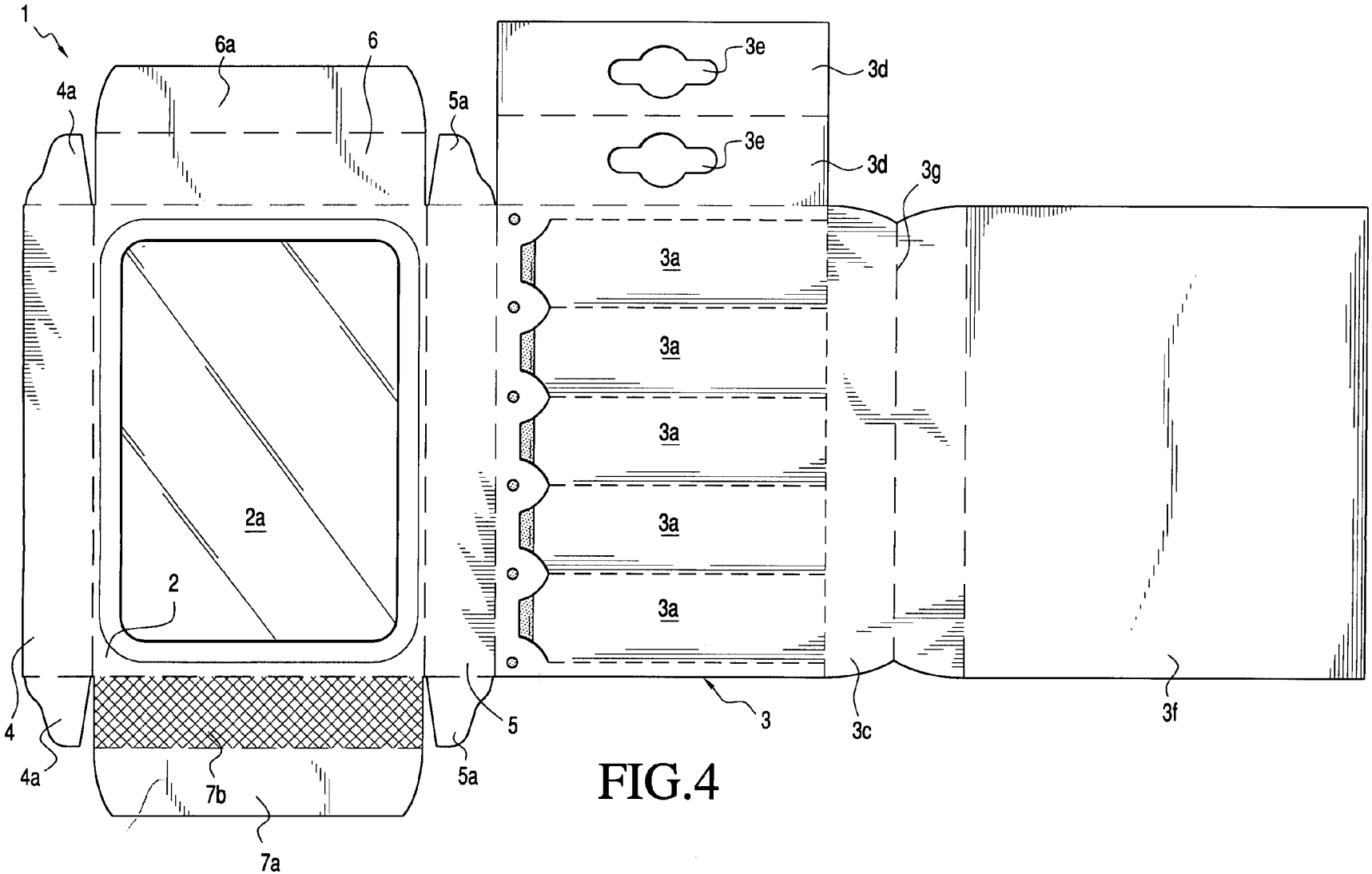
FIG. 4 is a top plan view of a blank, cut and scored before being folded into another embodiment of the invention.
Figure 5:
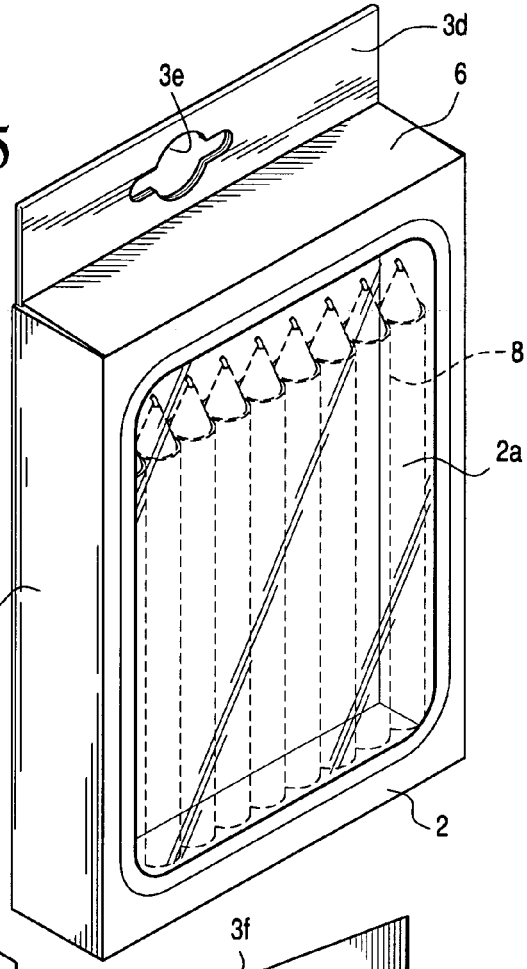
FIG. 5 is a front perspective view of the package wherein the blank of FIG. 4 has been folded to form another embodiment of the invention.
Figure 6:
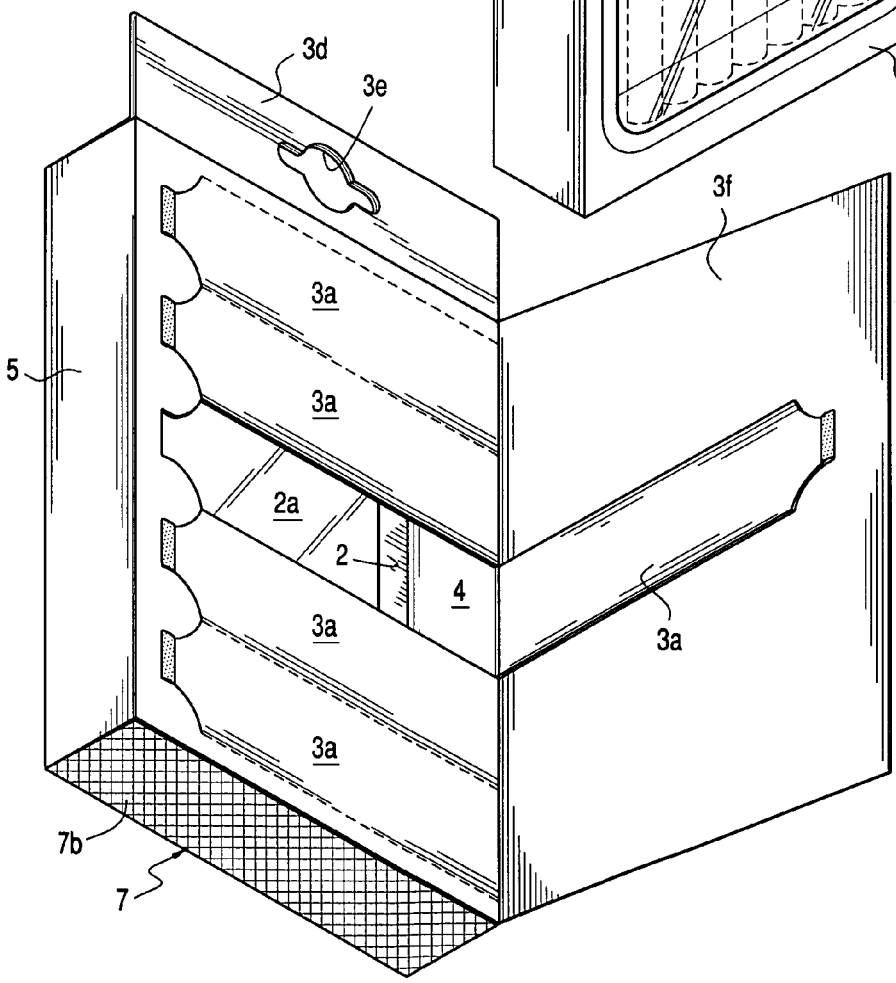
FIG. 6 is a rear perspective view of the package shown in FIG. 5, showing a rear panel pivoted to the open position to expose the matches, and illustrating a match being pulled from a group of matches.

Another embodiment of the invention is illustrated in FIGS. 4, 5 and 6 wherein the back panel 3 is provided with an additional panel portion 3*f* connected to the flap portion 3*c* along a fold line 3*g*. When the blank is folded to form the container, shown in FIGS. 5 and 6, the panel portion 3*f* is folded to a position overlying the matches 3*a*, to thereby provide a cover for the matches similar too a cover on a book of matches.

Figure 7:
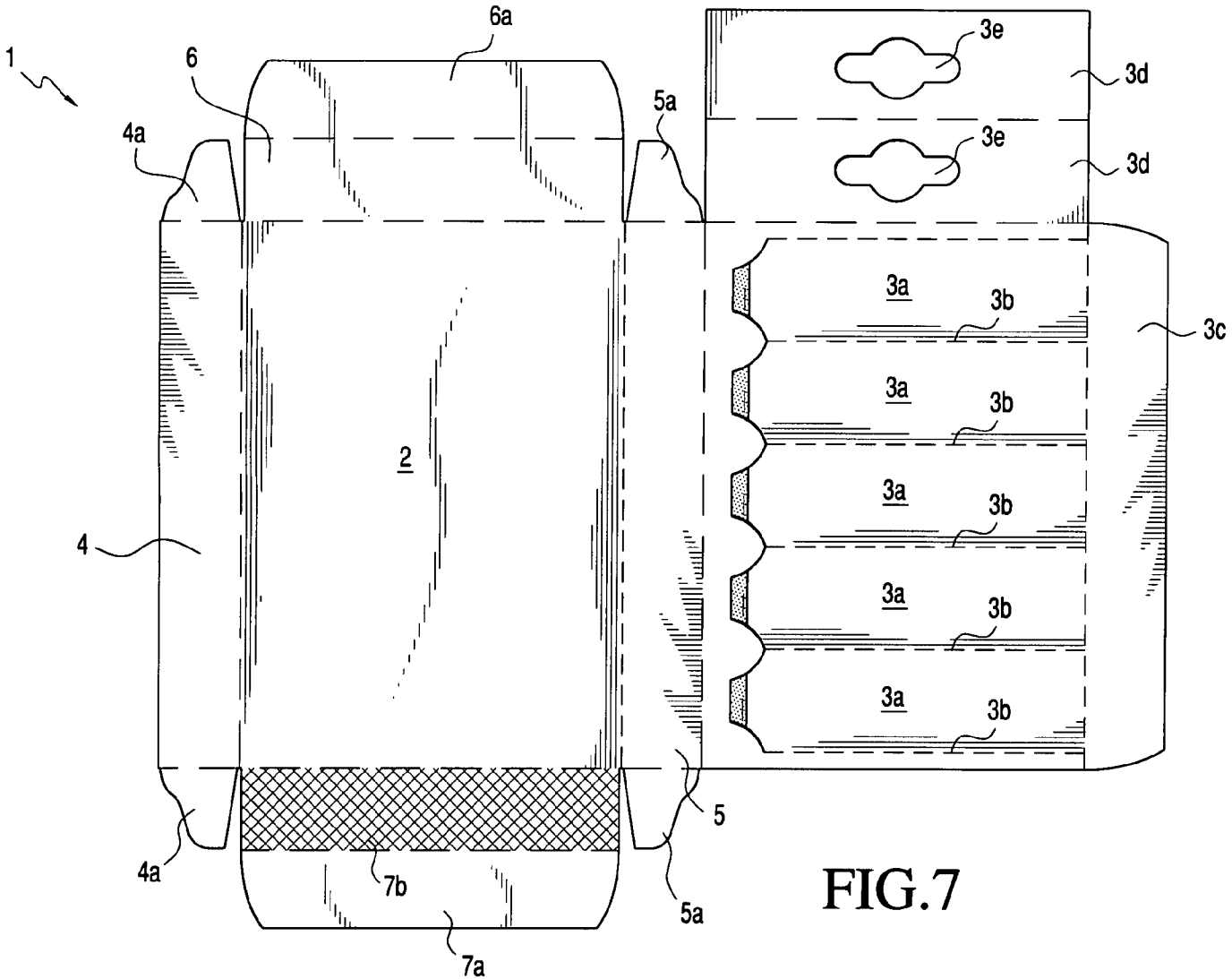
FIG. 7 is a top plan view of a blank, cut and scored before being folded to form yet another embodiment of the invention.
Figure 8:
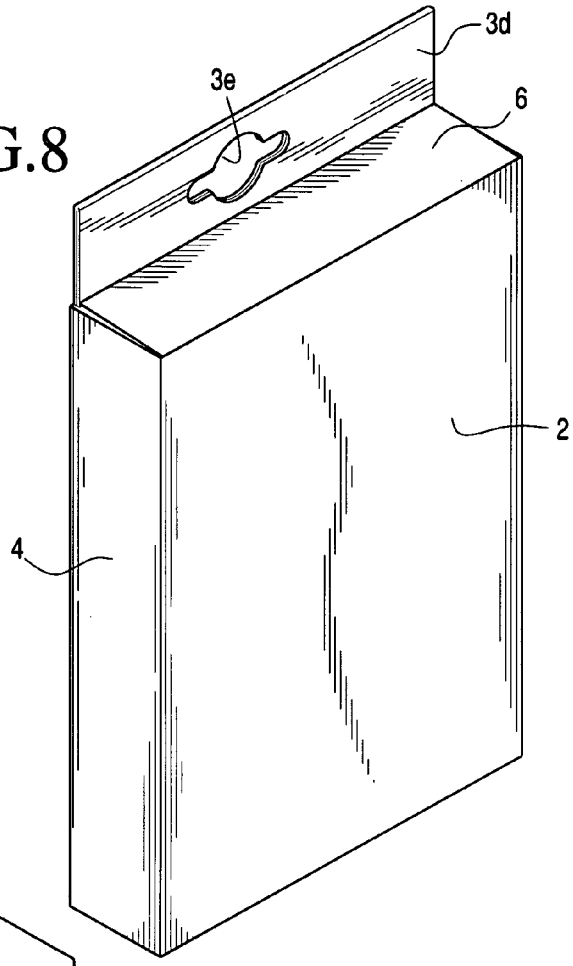
FIG. 8 is a front perspective view wherein the blank of FIG. 7 has been folded to form yet another embodiment of the invention; and, FIG. 9 is a rear perspective view of the package shown in FIG. 8, showing a match being pulled from the back wall of the package.
Figure 9:
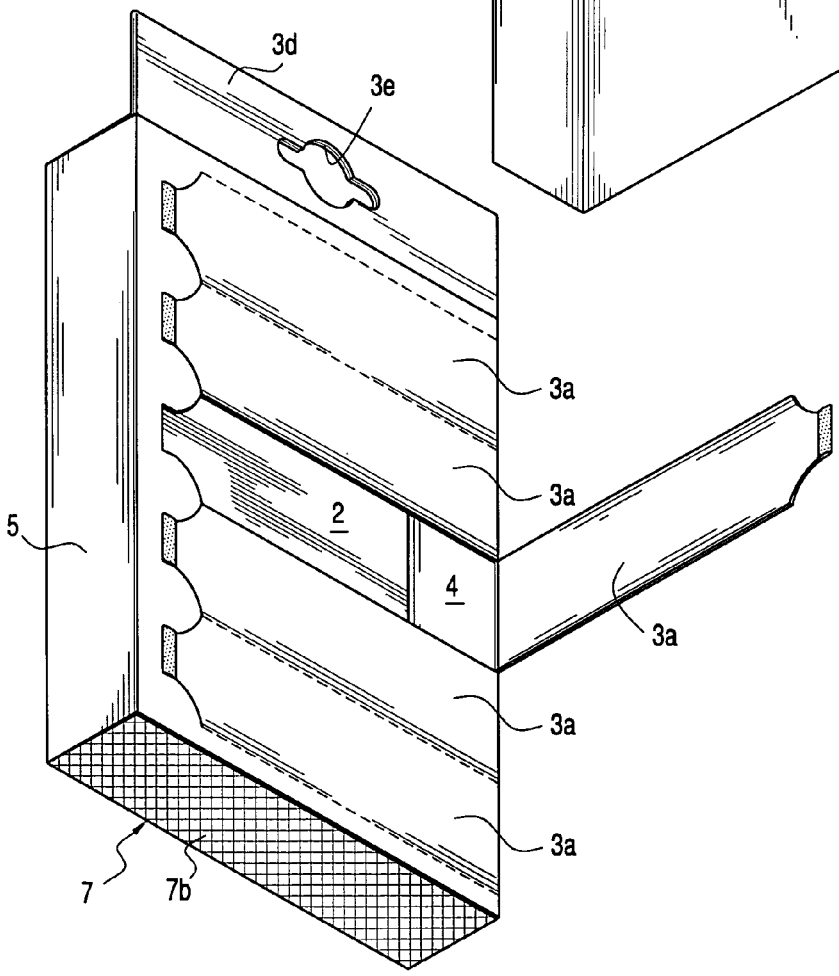

FIGS. 7, 8 and 9 illustrate yet another embodiment of the invention wherein the front panel 2 of the blank is continuous and therefore not provided with a window portion, as shown in FIG. 8.

From the above description, it will be appreciated by those skilled in the art that the combined birthday candle and match package of the present invention is an improvement over prior candle-match containers in that the candle-match package of the present invention is simple in construction; and by having the matches as an integral part of the container, they will remain with the package until the last match is used.

It is to be understood that the form of the invention herewith shown and described is to be taken as a preferred example of the same, and that various changes in the shape, size and arrangement of parts may be resorted to, without departing from, the spirit of the invention or scope of the subjoined claims.

I claim:

1. A combined candle and match package comprising a container having front, back, side and end walls, a plurality of matches being integral with a wall of the container, means for detachably connecting each match from said wall, a match striking surface on another wall of said container, and a plurality of candles contained in said container.

2. The combined candle and match package according to claim 1, wherein the matches are integral with the back wall of the container.

3. The combined candle and match package according to claim 2, wherein the back wall of the container and matches are co-planar.

4. The combined candle and match package according to claim 3, wherein the means for detachably connecting each match from the wall comprises perforations positioned between each match and the back wall.

5. The combined candle and match package according to claim 1, wherein a plurality of birthday candles are contained in said container.

6. The combined candle and match package according to claim 1, wherein a striking surface is provided on an end wall of the container.

7. The combined candle and match package according to claim 1, wherein the front wall is provided with a window portion.

8. The combined candle and match package according to claim 3, wherein a panel is connected to the container back wall along a fold line, to thereby provide a cover for the matches.

* * * * *